US007572025B2

(12) United States Patent
Shibusawa et al.

(10) Patent No.: US 7,572,025 B2
(45) Date of Patent: Aug. 11, 2009

(54) SHOWCASE

(75) Inventors: Sakumi Shibusawa, Ota (JP); Atsushi Todoroki, Gyouda (JP); Masaru Sekine, Sano (JP); Seiji Kataoka, Ota (JP); Yoshiki Makishima, Ota (JP); Tetsuya Oketani, Ota (JP); Katsuya Kobayashi, Isesaki (JP)

(73) Assignee: Sanyo Electric Co., Ltd., Moriguchi-Shi (JP)

( * ) Notice: Subject to any disclaimer, the term of this patent is extended or adjusted under 35 U.S.C. 154(b) by 0 days.

(21) Appl. No.: 12/071,630

(22) Filed: Feb. 25, 2008

(65) Prior Publication Data

US 2008/0205041 A1 Aug. 28, 2008

(30) Foreign Application Priority Data

Feb. 26, 2007 (JP) ..... 2007-045440

(51) Int. Cl.
*F21V 33/00* (2006.01)

(52) U.S. Cl. ..... 362/92; 362/96; 362/126; 362/800

(58) Field of Classification Search ..... 362/92, 362/96, 125, 126, 800
See application file for complete search history.

(56) References Cited

U.S. PATENT DOCUMENTS 7,163,305 B2 * 1/2007 Bienick ..... 362/125

FOREIGN PATENT DOCUMENTS

| | | |
|---|---|---|
| DE | 297 17 444 U1 | 1/1998 |
| EP | 1 120 069 A1 | 8/2001 |
| EP | 1 627 583 A1 | 2/2006 |
| GB | 378 639 | 8/1932 |
| JP | 5-146346 | 6/1993 |

OTHER PUBLICATIONS

European Search Report of Jul. 21, 2008.

* cited by examiner

*Primary Examiner*—Stephen F Husar
(74) *Attorney, Agent, or Firm*—Kratz, Quintos & Hanson, LLP

(57) ABSTRACT

There is disclosed a showcase provided with a light device capable of simplifying a maintenance operation and improving a cooling efficiency in a display chamber. In a showcase 1 of the present invention, a display chamber 11 is formed in an insulating wall 2 to display commodities on shelf plates 32 of a plurality of steps of shelves disposed in the display chamber 11 and cool the commodities, the showcase includes LED lights 40 which illuminate the inside of the display chamber 11 from the upside, and the shelf plates 32 and the like constituting the shelves are constituted of a transparent material.

1 Claim, 9 Drawing Sheets

FIG. 6

| Kind of lighting | T10 fluorescent lamp | T5 tube fluorescent lamp | LED |
|---|---|---|---|
| Lighting of Canopy | EXIST(1 line) | EXIST(1 line) | EXIST(1 line) |
| Lighting of Ceiling board of chamber | EXIST(1 line) | EXIST(1 line) | Not exist |
| Lighting of under shelf | EXIST(1 line 4 steps) | EXIST(1 line 4 steps) | Not exist |
| Illuminance at first shelf (A)LX | 1260 | 1800 | 2380 |
| Illuminance at Second shelf (B)LX | 830 | 1300 | 1520 |
| Illuminance at third shelf (C)LX | 600 | 700 | 1000 |
| Illuminance at fourth shelf (D)LX | 600 | 470 | 812 |
| Demand of lighting W | 468 | 356 | 198 |
| Rate of energy saving | 100 | 76 | 42 |

SHOWCASE

CROSS-REFERENCE TO RELATED APPLICATIONS

This application is a co-pending application of: U.S. Ser. No. 12,071,629 filed on Feb. 25, 2008; U.S. Ser. No. 12,071,631 filed on Feb. 25, 2008; U.S. Ser. No. 12,071,632 filed on Feb. 25, 2008; and U.S. Ser. No. 12,071,633 filed on Feb. 25, 2008.

BACKGROUND OF THE INVENTION

1. Field of the Invention

The present invention relates to a showcase in which a display chamber is formed in an insulating wall to display commodities in the display chamber while cooling the commodities. More particularly, it relates to lights in the display chamber.

2. Description of the Related Art

Heretofore, as this type of showcase, for example, there has been an open showcase 100 disclosed in Patent Document 1 and shown in FIG. 10. FIG. 10 shows a vertical side view of the conventional open showcase 100. In this open showcase 100, cold air is discharged from a discharge port 103 formed in an upper edge of an opening 102 of an insulating wall 101 having a substantially U-shaped section toward a suction port 104 of a lower edge of the opening 102, whereby a cold air curtain is formed in the opening 102. In consequence, the inside of a display chamber 105 surrounded with the insulating wall 101 is cooled to a predetermined temperature. Then, a plurality of fluorescent lamps 108 are attached to a canopy 107 positioned outside the upper edge of the opening 102, opposite side edges of the opening 102 and lower surfaces of front parts of shelves 106 to illuminate the inside of the display chamber 105 and the showcase 100 itself.

[Patent Document 1] Japanese Patent Application Laid-Open No. 5-146346

However, in the conventional open showcase 100, the fluorescent lamps 108 are used as light devices, and the fluorescent lamps 108 are provided on an upper front part of the display chamber 105, the lower surfaces of the shelves 106 disposed in the display chamber 105 and the like, so that there has been a problem that a thermal load is generated in the display chamber 105 owing to the fluorescent lamps 108. A usual fluorescent lamp converts electric energy into visible radiation, infrared radiation and ultraviolet radiation to radiate a visible ray for use as the light. In this case, a thermal loss is generated, and hence there is a problem that the inside of the display chamber 105 is heated by not only the fluorescent lamps themselves but also radiant heat of the fluorescent lamps.

Therefore, in a cooling showcase in which the inside of the display chamber 105 is cooled to the predetermined temperature, a cooling operation is performed in consideration of a thermal load due to the light, so that a cooling efficiency lowers. In consequence, there has been a problem that steep rise of running cost is incurred. Commodities displayed in the display chamber 105 are irradiated with an ultraviolet ray, so that there is a problem that the commodities are adversely affected.

Furthermore, the fluorescent lamps have a problem that flicker is generated owing to use of an alternating current, so that there is a problem that eyes are adversely affected.

In addition, to attach the fluorescent lamps 108 in the display chamber 105, components such as sockets and stabilizers are required. Therefore, in attachment positions, attachment places for not only the fluorescent lamps but also the sockets, stabilizers and the like need to be secured. The fluorescent lamps have to be connected to wires in order to supply power to the lamps. There are problems that assembly operability is deteriorated and that increase of the number of the components and steep rise of production cost are incurred.

In recent years, a thickness of the whole shelves 106 tends to be reduced for a purpose of improving a display efficiency in the display chamber 105. In actual, there is a problem that a thickness dimension of each shelf 106 is limited by the fluorescent lamp provided under the shelf 106.

Moreover, a replacement operation of the fluorescent lamps 108 is forcibly required owing to luminance decrease and light defect caused with elapse of years. Therefore, a user is forced to perform the replacement operation of the fluorescent lamps 108, and the operation disadvantageously becomes laborious. The new fluorescent lamp 108 for replacement needs to be always prepared, and a storage place of the fluorescent lamp 108 needs to be secured. Furthermore, the fluorescent lamp 108 contains mercury, resulting in a problem that the used fluorescent lamp 108 cannot easily be discarded.

SUMMARY OF THE INVENTION

The present invention has been developed in order to solve a conventional technical problem, and an object thereof is to provide a showcase provided with a light device in which a maintenance operation can be simplified and a cooling efficiency in a display chamber can be improved.

In a showcase according to the present invention, a display chamber is formed in an insulating wall to display commodities on a plurality of steps of shelves disposed in the display chamber and cool the commodities, and the showcase is characterized by comprising LED lights which illuminate the inside of the display chamber from the upside, the shelves being constituted of a transparent material.

A showcase according to the invention of a second aspect is characterized in that in the above invention, cold air is discharged from a cold air discharge port provided in an upper edge of a front surface opening of the display chamber, and sucked into a cold air suction port provided in a lower edge of the opening, to form a cold air curtain in the front surface opening of the display chamber, the showcase further comprises a canopy which protrudes forward from an upper front end of the insulating wall; and a reflective plate provided on an inner side of the canopy and positioned before the cold air discharge port, the LED lights being attached to the reflective plate, the front surface opening of the display chamber being irradiated with light emitted from the LED lights.

According to the present invention, the showcase in which the display chamber is formed in the insulating wall to display the commodities on the plurality of steps of shelves disposed in the display chamber and cool the commodities comprises the LED lights which illuminate the inside of the display chamber from the upside, and the shelves are constituted of the transparent material. In consequence, the LED lights which illuminate the inside of the display chamber from the upside can effectively illuminate the inside of the display chamber. Moreover, the light of the LED lights emitted from the upside passes through the shelves constituted of the transparent material, whereby the light emitted from the LED lights can be allowed to travel over the whole inside of the display chamber, and a lighting effect of the whole display chamber can be improved.

Therefore, the commodities on the shelves can be illuminated without especially providing light fixtures on the shelves. This can obviate the need for components to be attached to the lights, for example, sockets for attaching these light fixtures, and a constitution of the shelves can be simplified.

Moreover, the LED lights can produce a lighting effect similar to that produced in a case where light devices such as a plurality of fluorescent lamps are provided in the display chamber as in a conventional example. Therefore, power consumption of the whole showcase can remarkably be reduced. The LED lights do not radiate any harmful ultraviolet ray or heat ray to the commodities displayed in the display chamber, so that the commodities can be illuminated without being heated, and lowering of a cooling efficiency of the showcase itself due to a thermal load can be prevented in advance. In consequence, running cost of the whole showcase can be reduced.

Furthermore, it is possible to avoid a disadvantage that the commodities are adversely affected by the harmful ultraviolet ray of the lights. In consequence, the commodities can be displayed while fresher states thereof are maintained.

According to the invention of the second aspect, in addition to the above invention, the cold air is discharged from the cold air discharge port provided in the upper edge of the front surface opening of the display chamber, and sucked into the cold air suction port provided in the lower edge of the opening, to form the cold air curtain in the front surface opening of the display chamber, the showcase further comprises the canopy which protrudes forward from the upper front end of the insulating wall, and the reflective plate provided on the inner side of the canopy and positioned before the cold air discharge port, the LED lights are attached to the reflective plate, and the front surface opening of the display chamber is irradiated with the light emitted from the LED lights. In consequence, the LED lights can effectively illuminate the whole inside of the display chamber from the upper front part of the display chamber.

In consequence, faces of the commodities displayed on the shelves can effectively be illuminated. Moreover, the light emitted from the LED lights to irradiate the inside of the display chamber passes through the shelves constituted of the transparent material and disposed in the display chamber, whereby the light can be allowed to travel over the whole inside of the display chamber, and the lighting effect of the whole display chamber can be improved.

In particular, the LED lights are provided outside the cold air curtain, whereby the thermal load concerning the lights in the display chamber can be zeroed, and the lowering of the cooling efficiency of the showcase itself can be prevented in advance. In consequence, the running cost of the whole showcase can be reduced.

BRIEF DESCRIPTION OF THE DRAWINGS

FIG. 6 is a diagram showing a result of illuminance measurement;

DESCRIPTION OF THE PREFERRED EMBODIMENT

Figure 1:
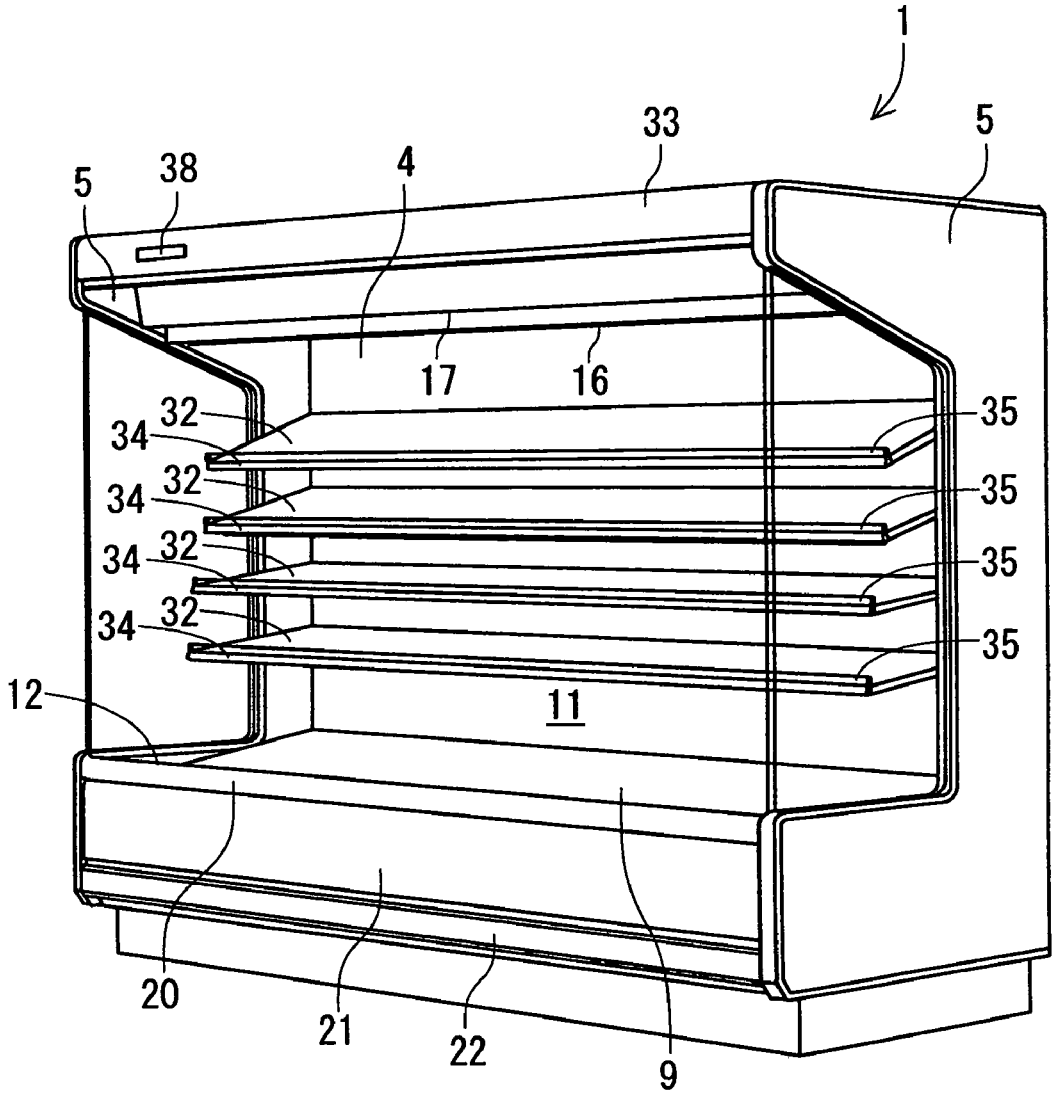
FIG. 1 is a perspective view of an open showcase to which the present invention is applied.
Figure 2:
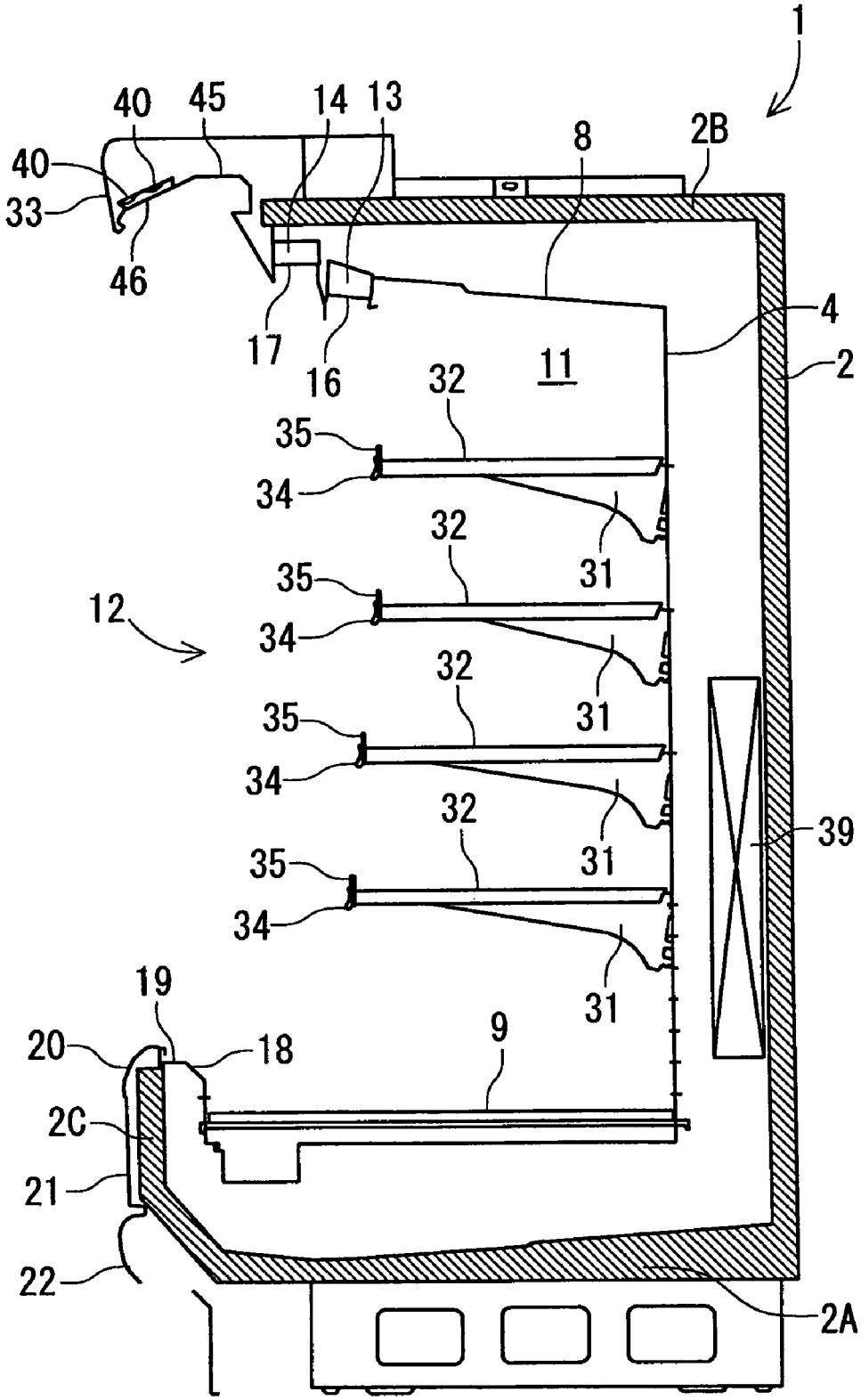
FIG. 2 is a vertical side view of the open showcase shown in FIG. 1.

Next, an embodiment of the present invention will be described in detail with reference to the drawings. FIG. 1 shows a perspective view of an open showcase 1 to which the present invention is applied, and FIG. 2 shows a vertical side view of the open showcase 1 shown in FIG. 1, respectively. The open showcase 1 is a vertical open showcase to be installed in a store such as a supermarket, and is constituted of an insulating wall 2 opened in a front surface and having a substantially U-shaped section, and insulating side plates 5, 5 attached to side surfaces of the insulating wall 2 in an installation spot.

A partition plate 4 and another partition plate (not shown) are attached on an inner side of the insulating wall 2 of the open showcase 1 so that a space is formed between the wall and each partition plate, and two inner and outer layer ducts are formed between the insulating wall 2 and the partition plate 4 and the like. A bottom plate 9 is attached to a front part of a lower end of a back partition plate 10 constituting the inner partition plate so that a space for the duct is secured between the bottom plate and a bottom wall 2A of the insulating wall 2. A display chamber 11 is formed on inner sides of the partition plate 4 and the bottom plate 9.

Moreover, in this display chamber 11, a pair of brackets 31 are attached to a support (not shown) of a back part in the display chamber 11 so that heights and attachment angles of the brackets can be changed, and a plurality of steps of shelf plates 32 each including the brackets to constitute a shelf together are disposed. Price rails 34 molded of a hard synthetic resin are attached to front edges of the shelf plates 32, and the price rails 34 also serve as decorative members of the shelf plates 32. A predetermined space is formed between a front wall of each shelf plate 32 and the price rail 34, and a guard 35 for preventing commodities on the shelf plate 32 from dropping down is attached to the space.

It is to be noted that in the present embodiment, the shelf plates 32 are constituted of a transparent material having a light transmission property, for example, a glass plate or an acryl plate. The shelf plates 32 constituted of the transparent material have a predetermined strength. In addition, the brackets 31 for attaching the shelf plates 32 to the supports, the price rails 34, the guards 35 and the like may similarly be constituted of a transparent material.

An inner layer discharge port 16 and an outer layer discharge port 17 to which honeycomb materials 13, 14 are attached, respectively, are arranged in an upper edge of a front surface opening 12 of the insulating wall 2, and these inner layer discharge port 16 and outer layer discharge port 17 communicate with the inner layer duct and the outer layer duct, respectively. An inner layer suction port 18 and an outer layer suction port 19 are arranged in a lower edge of the opening 12.

On the other hand, a plurality of blowers (not shown) for the inner layer duct and the outer layer duct are installed on the bottom wall 2A of the insulating wall 2 in a rear part under the bottom plate 9.

A cooler 39 of a cooling device is vertically provided in the inner layer duct behind the back partition plate 10. In a case where the blower disposed for the inner layer duct is operated, cold air which has performed heat exchange between the air and the cooler is raised in the inner layer duct, and discharged from the inner layer discharge port 16 toward the inner layer suction port 18. Then, the cold air sucked from the inner layer suction port 18 is again accelerated by the blower.

On the other hand, in a case where the blower disposed for the outer layer duct is operated, air in the outer layer duct is raised in the outer layer duct, and discharged from the outer layer discharge port 17 toward the outer layer suction port 19. Then, the air sucked from the outer layer suction port 19 is again accelerated by the blower. In consequence, double front and rear air curtains are formed in the opening 12, and the air of a part of the inner cold air curtain is circulated through the display chamber 11 to cool the display chamber 11.

On the other hand, a hand rail 20 provided over the whole width of the lower edge of the opening 12 of the open showcase 1 is attached to an upper surface of a lower front wall 2C of the insulating wall 2. A front surface lower panel 21 is attached to the front surface of this front wall 2C so as to continue to the hand rail 20, and a bumper 22 is attached under the front surface lower panel 21 so that a plane of the bumper is the same as that of the front surface lower panel 21.

Figure 3:
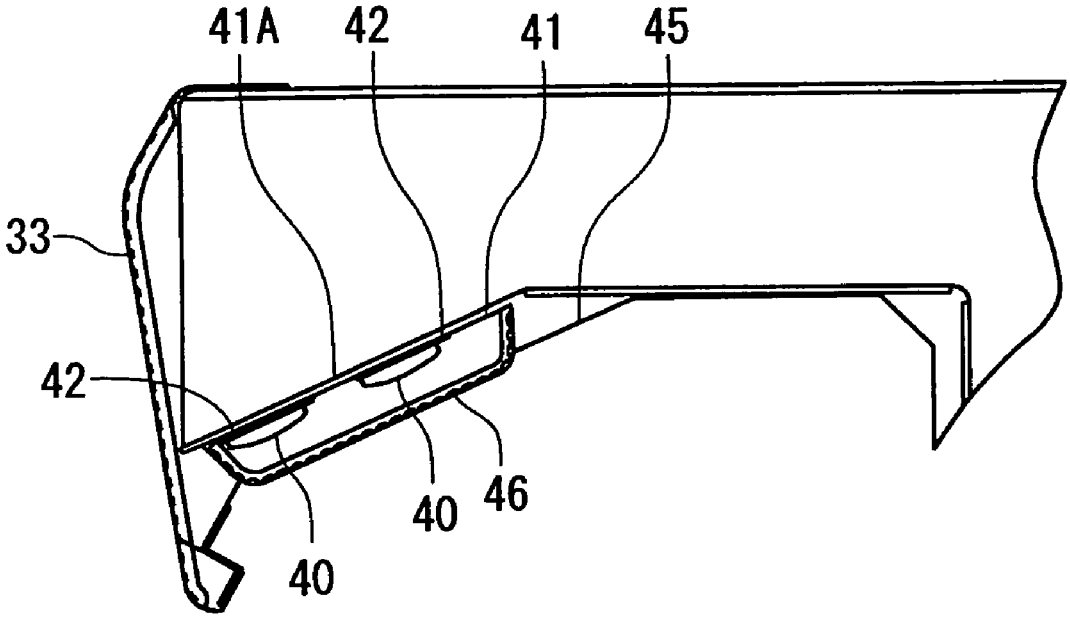
FIG. 3 is a partially enlarged sectional view of FIG. 2.
Figure 4:
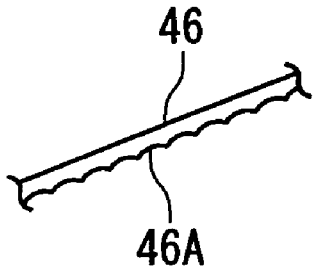
FIG. 4 is a sectional view of a shade.
Figure 5:
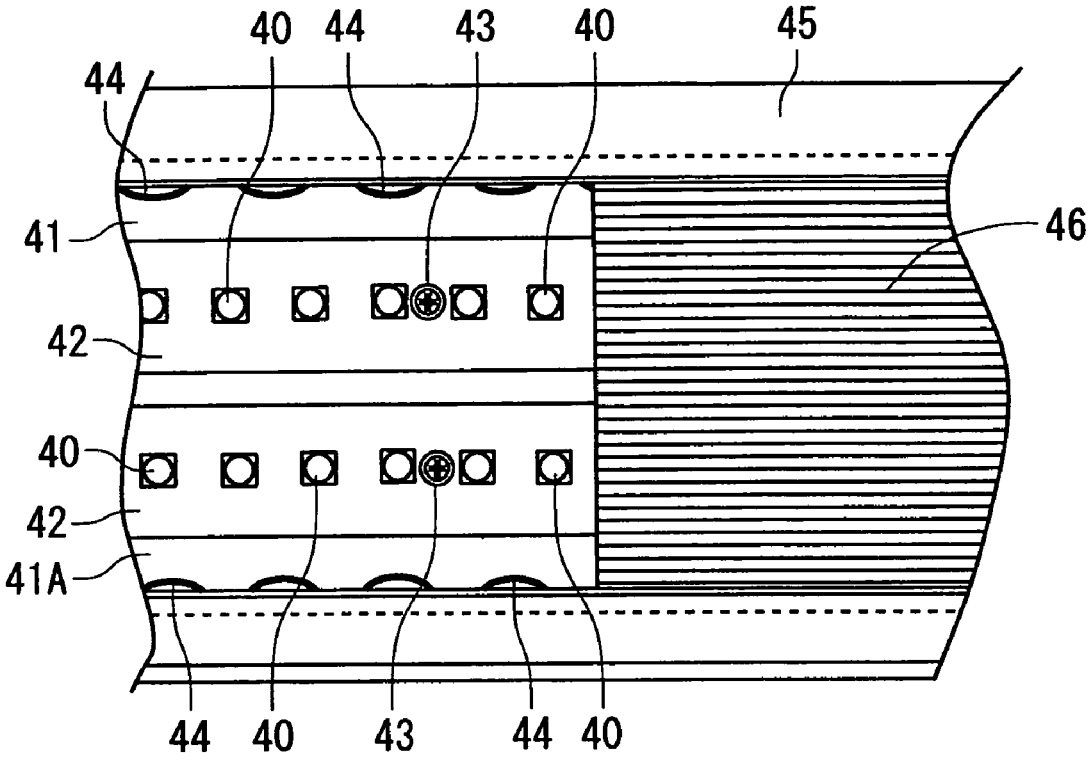
FIG. 5 is a diagram showing an attached state of LED lights.

Next, a constitution of a front part of a ceiling wall 2B of the insulating wall 2 will be described with reference to FIGS. 3 to 5. FIG. 3 shows a partially enlarged sectional view of FIG. 2, FIG. 4 is an enlarged sectional view of a shade 46, and FIG. 5 is a diagram showing an attached state of LED lights 40.

A canopy 33 which protrudes forward is attached to a front end (an upper part front end) of the ceiling wall 2B of the insulating wall 2, and a reflective plate 45 is attached to an inner side of the canopy 33 so that the reflective plate protrudes externally from the front surface opening 12 of the display chamber 11. It is to be noted that a temperature indicator 38 is provided on the front surface of the canopy 33 as shown in FIG. 1.

This reflective plate 45 is constituted of a metal plate decorated with painting, and a front part of the plate is provided with a light attachment portion 41 which is recessed over a longitudinal direction. This light attachment portion 41 opens toward the front surface opening 12 of the display chamber 11 positioned in a rear part under the light attachment portion, and front and rear edges of the light attachment portion 41 are formed to slightly tilt toward the opening in a direction in which the edges come close to each other.

Then, the surface of this light attachment portion 41 which faces the opening is a light attachment surface 41A, and the surface is disposed at an angle opposed to the front surface opening 12 of the display chamber 11 from an upper front part, that is, the surface is constituted so as to face the display chamber 11 in an obliquely rear part under the light attachment surface. The LED lights 40 are attached to the light attachment surface 41A.

The plurality of LED lights 40 are attached to substrates 42 which extend in the longitudinal direction at predetermined intervals. The substrates 42 provided with the LED lights 40 are fixed via a plurality of fixing screws 43 . . . in a state in which the substrates abut on the light attachment surface 41A. It is to be noted that the LED lights 40 for use in the present embodiment are of a chip type of white LED light (product number NS6W083T) manufactured by Nichia Corporation. One line or two front and rear lines or more of LED lights 40 may be arranged, and in the present embodiment, two lines of LED lights are provided. In the present embodiment, the front surface opening 12 of the open showcase 1 is formed so as to extend as long as six shaku (about 1830 mm), so that about 108 LED lights 40 are used.

Moreover, the light attachment surface 41A of the reflective plate 45 to which the LED lights 40 are attached is provided with a plurality of exhaust holes 44 disposed over the longitudinal direction as shown in FIG. 5.

Then, the light attachment surface 41A of the light attachment portion 41 is covered with a shade 46 attached so as to surround the LED lights 40, the substrates 42 and the exhaust holes 44 from the downside. The shade 46 has a shape curved at such a predetermined curvature as to protrude toward the front surface opening 12 of the display chamber 11. It is to be noted that the shade 46 is fitted into the light attachment portion 41 of the reflective plate 45, whereby the shade is detachably attached. FIG. 5 shows a state in which the shade 46 is attached to a part of the light attachment portion 41.

This shade 46 is constituted of a colorless transparent material having a light transmission property. In the present embodiment, to diffuse light from the LED lights 40 toward the front surface opening 12 of the display chamber 11, the surface of the shade which faces the LED lights 40 is formed to be flat and smooth, and an outer surface 46A of the shade 46 is formed into a wave-like section or a sawtooth-like section as shown in FIG. 4.

In consequence, light traveling rectilinearly in parallel from the LED lights 40 enters the shade 46, is then refracted in multiple directions by the outer surface 46A formed into the waveform section or the sawtooth-like section, and can be diffused in a broad region.

According to such a constitution, when the LED lights 40 are lit, the irradiation light of the LED lights 40 diffused in the shade 46 can effectively illuminate the whole inside of the display chamber 11 from an upper front part positioned outside the display chamber 11.

Figure 7:
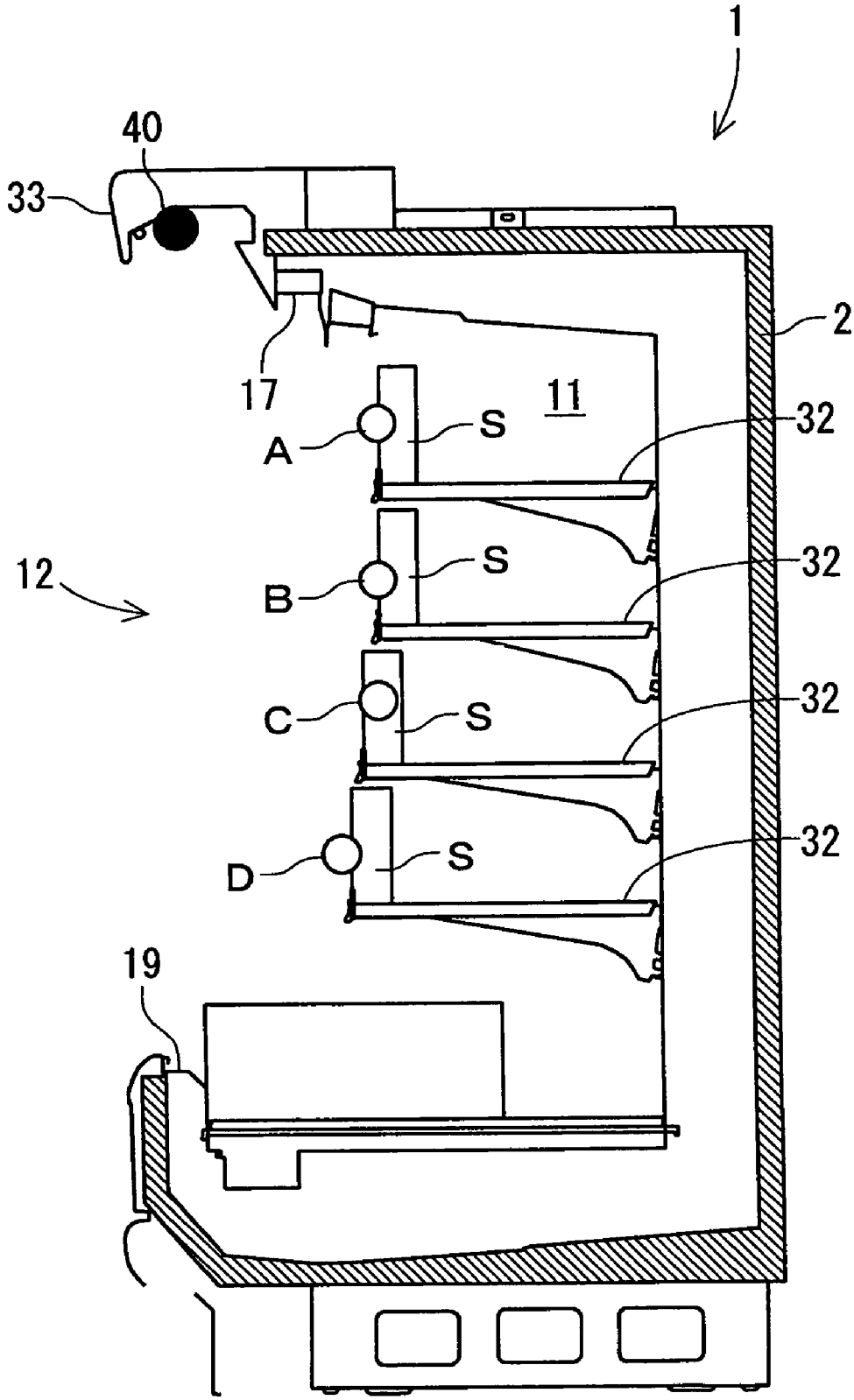
FIG. 7 is a vertical side view of a showcase used in the illuminance measurement of FIG. 6.
Figure 10:
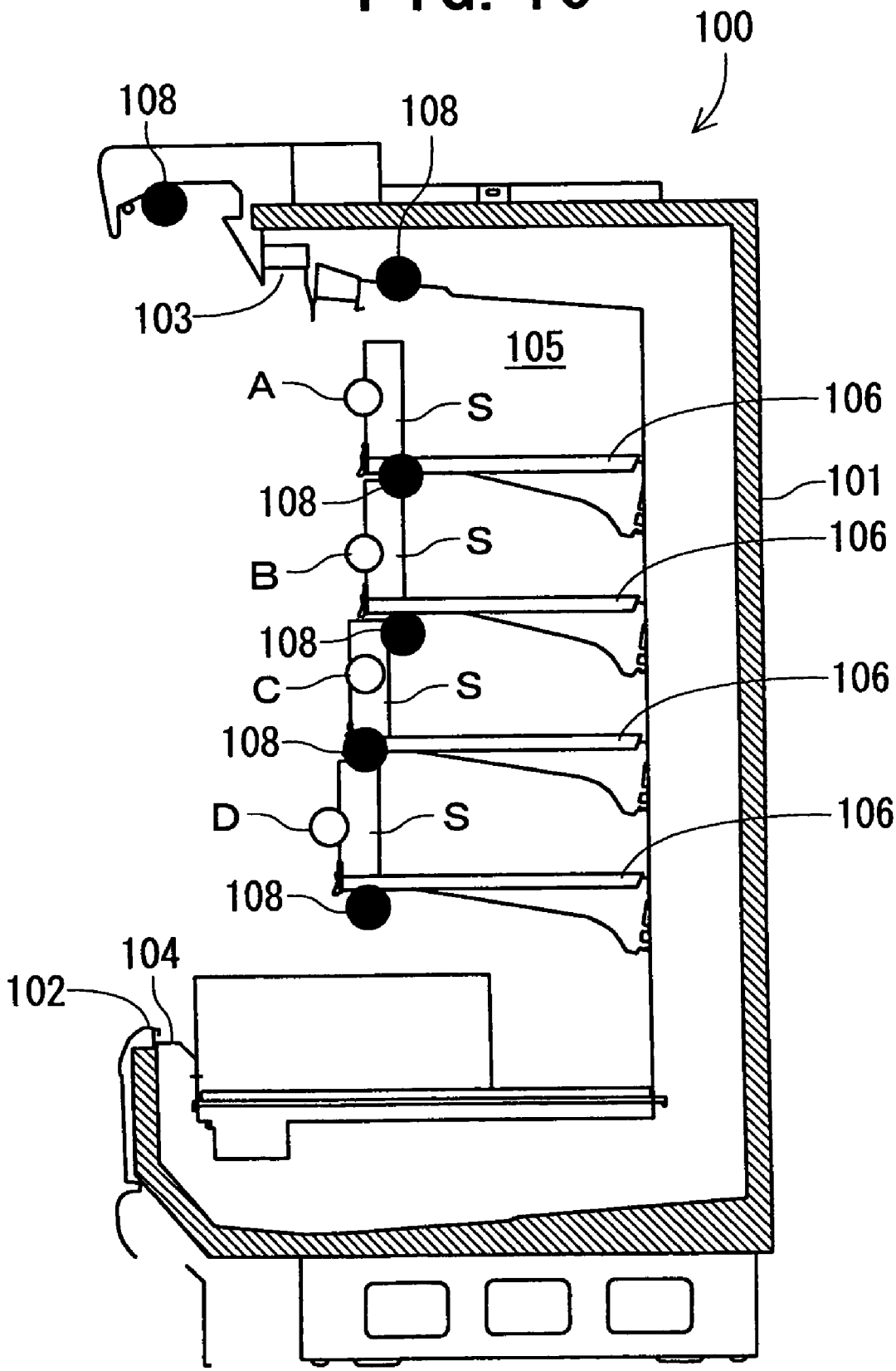
FIG. 10 is a vertical side view of a conventional open showcase.

Here, a case where the inside of the display chamber 11 is illuminated with the conventional fluorescent lamps is compared with a case where the inside of the display chamber 11 is illuminated with the LED lights 40 as in the present embodiment with reference to experiment results of FIG. 6. In such an experiment, the same showcase except the lights is used for comparison. As experiments using the conventional fluorescent lamps, there are shown two types of experiments including an experiment in which T10 fluorescent lamps (ϕ32 mm) are used in a canopy, a ceiling board of a chamber and lower surfaces of front parts of four shelves 106 as shown in FIG. 10 and an experiment in which T5 tube (ϕ16 mm) fluorescent lamps are used. On the other hand, as an experiment using the LED lights 40 as in the present embodiment, an experiment is shown in which one line of the LED lights 40 are attached to the canopy 33 as shown in FIG. 7.

Then, the four shelves were disposed in the display chamber of each open showcase 1, and commodities S were mounted on an upper front end of each shelf, followed by measuring illuminance of the light for irradiating the face of each commodity was irradiated. It is to be noted that the face of the commodity S on the top shelf is point A, the face of the commodity S on the second shelf is point B, the face of the commodity S on the third shelf is point C, and the face of the commodity S on the fourth shelf is point D.

According to this measurement, with regard to the illuminance of each point in a case where the T10 fluorescent lamps were used, the illuminance of the point A was 1260 LX, that of the point B was 830 LX, that of the point C was 600 LX, and that of the point D was 600 LX. With regard to the illuminance of each point in a case where the T5 tube fluorescent lamps were used, the illuminance of the point A was 1800 LX, that of the point B was 1300 LX, that of the point C was 700 LX, and that of the point D was 470 LX. It is seen that in the positions other than the point D, the illuminance of the T5 tube fluorescent lamp is high as compared with a case where the T10 fluorescent lamp is used.

On the other hand, in a case where the LED lights 40 were attached to the reflective plate 45 on the inner side of the canopy 33 as in the present embodiment, the illuminance of the point A was 2380 LX, that of the point B was 1520 LX, that of the point C was 1000 LX, and that of the point D was 812 LX. Therefore, it is seen that in any point, the illuminance of the light for irradiating the commodities mounted on the shelves is high in a case where the LED lights 40 are used as compared with a case where the fluorescent lamps are used as in the conventional example.

Moreover, when the total demands of lighting in the above-mentioned cases are compared, the total demand of lighting is 468 W in the case where the T10 fluorescent lamps are used, it is 356 W in the case where the T5 tube fluorescent lamps are used, and it is 198 W in the case where the LED lights 40 are used. Assuming that the demand of the case where the T10 fluorescent lamps are used is 100, the demand of the T5 tube fluorescent lamps is 76%, and the demand of the LED lights 40 is 42%.

Therefore, in a case where the LED lights 40 are used in illuminating the display chamber 11 as in the present embodiment, an equal or more lighting effect can be produced as compared with a case where light devices such as the plurality of fluorescent lamps are provided in the display chamber as in the conventional example. Therefore, even in a constitution in which the shelf plates 32 are not provided with self-emitting light fixtures, for example, a constitution in which light fixtures such as the fluorescent lamps are not provided on lower surfaces of the shelf plates 32 or the like, commodities to be displayed on the shelf plates 32, especially milk packages, plastic bottled beverages and the like are mounted in uprising states, and faces of the commodities which face the front surface opening 12 of the display chamber 11 can effectively be illuminated.

This obviates the need for the light fixtures on the shelf plates 32, whereby power leakage due to dew condensation can be prevented. This can also obviate the need for components to be attached to the lights, for example, sockets for attaching these light fixtures, stabilizers and the like. A constitution of the shelves can be simplified. Moreover, the number of the components can be reduced, so that productivity can be improved.

Moreover, the LED lights 40 attached to the reflective plate 45 of the canopy 33 can produce the lighting effect similar to that produced in the case where light devices such as the plurality of fluorescent lamps are provided in the display chamber as in the conventional example, so that power consumption of the whole open showcase 1 can remarkably be reduced.

Furthermore, the LED lights 40 do not radiate any harmful ultraviolet ray or heat ray to the commodities displayed in the display chamber 11, so that the commodities can be illuminated without being heated. In particular, the LED lights 40 which generate heat are provided on the inner side of the canopy 33 which protrudes forward from the upper front end of the insulating wall 2, so that the inside of the display chamber 11 is illuminated from the outside of the display chamber 11, that is, from the outside of the cold air curtain. Therefore, a thermal load concerning the lighting in the display chamber 11 can be zeroed, and lowering of the cooling efficiency of the showcase 1 itself can be prevented in advance. In consequence, running cost of the whole showcase 1 can be reduced.

Moreover, it is possible to avoid a disadvantage that the commodities are adversely affected by the harmful ultraviolet ray of the lights. In consequence, the commodities can be displayed while fresher states thereof are maintained.

On the other hand, the substrates 42 provided with the LED lights 40 are attached so as to abut on the reflective plate 45 constituted of a metal plate so that heat exchange between the substrates and the reflective plate can be performed. Therefore, exhaust heat generated from the substrates 42 of the LED lights 40 is transmitted to the reflective plate 45, whereby a heat release effect of the reflective plate 45 can be obtained. In consequence, the heat generated from the substrates 42 of the LED lights 40 can smoothly be released.

Furthermore, in the LED lights 40, unlike the heretofore used fluorescent lamps, any flicker is not generated, so that stable lights can be obtained, and the commodities can appropriately be illuminated. In addition, the LED lights 40 can easily be dimmed. Therefore, the dimming is performed in accordance with the commodities to be displayed in the display chamber 11, whereby further effective lighting can be performed.

Moreover, the LED lights 40 has a remarkably long life period as compared with the fluorescent lamp, and this can obviate the need for a replacement operation of the lights. Therefore, this can obviate the need for a laborious operation such as storage of replacement components or a treatment of wastes discharged owing to the replacement.

Furthermore, in the present embodiment, the light traveling rectilinearly in parallel from the LED lights 40 can be diffused in the multiple directions by the shade 46 which covers the LED lights 40 and which has a light transmission property, so that the front surface opening 12 of the display chamber 11 can be irradiated with the light from the LED lights 40 in a broad region. The whole inside of the display chamber 11 can effectively be illuminated even with the LED lights 40 from one direction.

In consequence, the commodities displayed so as to be opposed to the front surface opening 12 of the display chamber 11, especially the milk packages, the plastic bottled beverages and the like are mounted in the upright states, and the faces of the commodities which face the front surface opening 12 of the display chamber 11 can be illuminated with the light emitted from the LED lights 40 diffused via the shade 46. Therefore, the lighting effect of the commodities can be improved.

Moreover, in the present embodiment, the outer surface 46A of the shade 46 on a side opposite to the LED lights 40 is formed into the wave-like section or the sawtooth-like section. Therefore, the outer surface of the shade 46 formed into the wave-like section or the sawtooth-like section functions as a prism, and can refract, reflect and diffuse the light traveling rectilinearly in parallel from the LED lights in the multiple directions. The broad region can be irradiated with the light emitted from the LED lights by the shade.

Therefore, as described above, the light from the LED lights 40 can produce a lighting effect equal to or more than that produced in the case where light devices such as the plurality of fluorescent lamps are provided in the display chamber as in the conventional example.

Moreover, in the present embodiment, the shelf plates 32 and the like of the shelves disposed in the display chamber 11 are constituted of the transparent material as described above. Therefore, the shelves constituted of the transparent material are irradiated from above with the light emitted from the LED lights 40, and then the light passes through the shelves, whereby the light emitted from the LED lights 40 can travel through the whole display chamber 11 without being disturbed by the shelves, and the lighting effect of the whole display chamber 11 can be improved.

Therefore, according to such a constitution, the commodities on the shelves can be illuminated without providing any special light fixture on the shelf plates 32. This can obviate the need for the components to be attached to the lights, for example, the sockets for attaching these light fixtures and the like, and the constitution of the shelves can be simplified.

Figure 8:
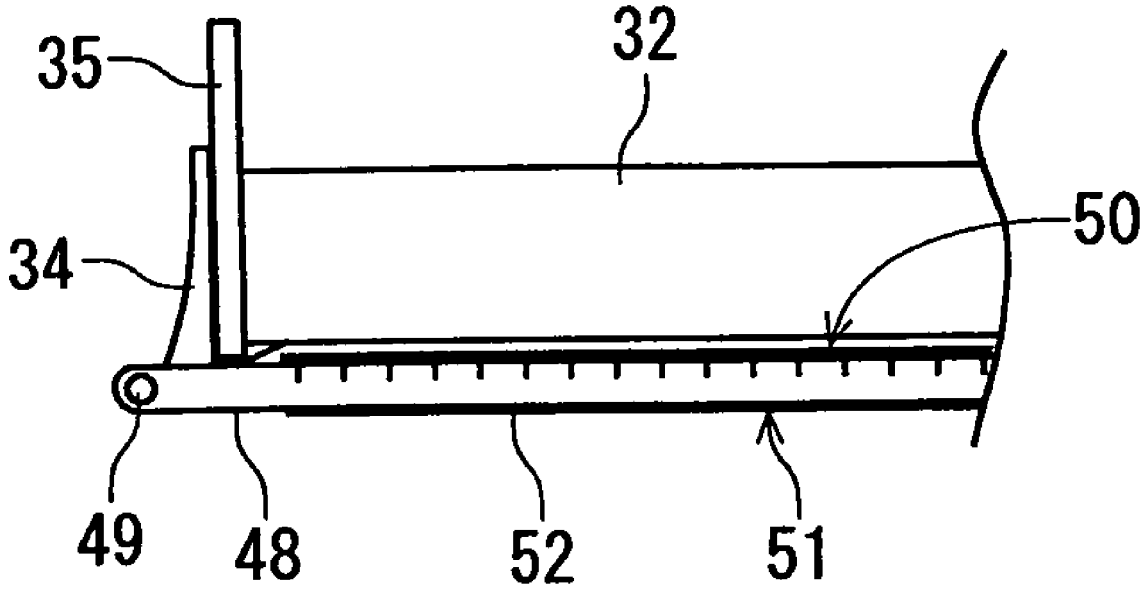
FIG. 8 is an enlarged sectional view of a shelf plate front part.

Moreover, in addition to the shelf plates 32 and the like constituted of the transparent material, as shown in FIG. 8, the shelf plate 32 may be constituted of a heretofore used steel plate material, and a light guide plate 48 may be attached to a lower surface of the shelf plate 32. This light guide plate 48 is constituted of, for example, an acryl resin or the like, and attached to the whole lower surface of the shelf plate 32 in a state in which the light guide plate slightly protrudes forward (toward the LED lights 40) from a front end of the shelf plate 32 (the whole shelf including the price rail 34 and the like). The front end of the light guide plate 48 disposed so as to protrude forward from the shelf plate 32 is provided with a light inlet portion 49. The ray inlet portion 49 is configured to receive the light from the LED lights 40 and reflect the light rearward.

On the other hand, the surface of the light guide plate 48 which faces the lower surface of the shelf plate 32 is provided with a plurality of grooves, scratches and the like for irregularly reflecting the derived light, and a reflective sheet 50 is attached to the corresponding surface. Then, a diffusion sheet 51 is attached to the surface of the light guide plate 48 opposite to the lower surface of the shelf plate 32, that is, a light emitting surface 52.

According to such a constitution, the inside of the display chamber 11 is illuminated from above with the LED lights 40, whereby the light emitted from the LED lights 40 is struck on the light inlet portion 49 of the light guide plate 48 provided so as to protrude forward from each shelf plate 32. In consequence, the light derived rearward from the light inlet portion 49 is irregularly reflected by the scratches formed on the surface of the light inlet portion on the side of the lower surface of the shelf plate 32, and the reflective sheet 50, and the light is then diffused by the diffusion sheet 51 on the facing light emitting surface 52, and emitted. Therefore, the irradiation light from the LED lights 40 is emitted from the light emitting surface 52 of the light guide plate 48 provided on the whole lower surface of the shelf plate 32 via the light guide plate 48.

Therefore, the diffused light is radiated from the light emitting surface 52 of the light guide plate 48, whereby the whole upper surface of the shelf plate 32 positioned under the shelf plate 32 provided with the light guide plate 48 so as to face the shelf plate is illuminated. Therefore, the inside of the display chamber 11 can be illuminated from above only with the LED lights 40 which illuminate the inside of the display chamber 11 from above. Moreover, not only the faces of the commodities mounted on the shelf plates 32 but also the commodities mounted on rear parts of the shelf plates 32 can be illuminated. In consequence, the whole inside of the display chamber 11 can effectively be illuminated.

In particular, to illuminate the shelf plate 32 provided with the light guide plate 48 disposed above the shelf plate, the light emitted from the LED lights 40 and struck on the light inlet portion 49 of the light guide plate 48 is emitted from the light emitting surface 52 of the light guide plate 48 disposed so as to face the shelf plate 32. Therefore, the light fixtures do not have to be especially disposed. This obviates the need for the sockets, wires and the like, and hence the constitution of the shelves can be simplified.

It is to be noted that in the present embodiment, the light guide plate 48 is provided over the whole lower surface of the shelf plate 32, but the present invention is not limited to such a constitution as long as the light guide plate is formed so as to extend along a depth dimension from a front side of the shelf plate 32.

Moreover, in addition to the constitution of the LED lights 40 provided on the inner side of the canopy 33 or instead of the constitution of the LED lights 40, it may be constituted that the inside of the display chamber 11 may be illuminated with the LED lights 40 from a lower front part of the display chamber 11.

Figure 9:
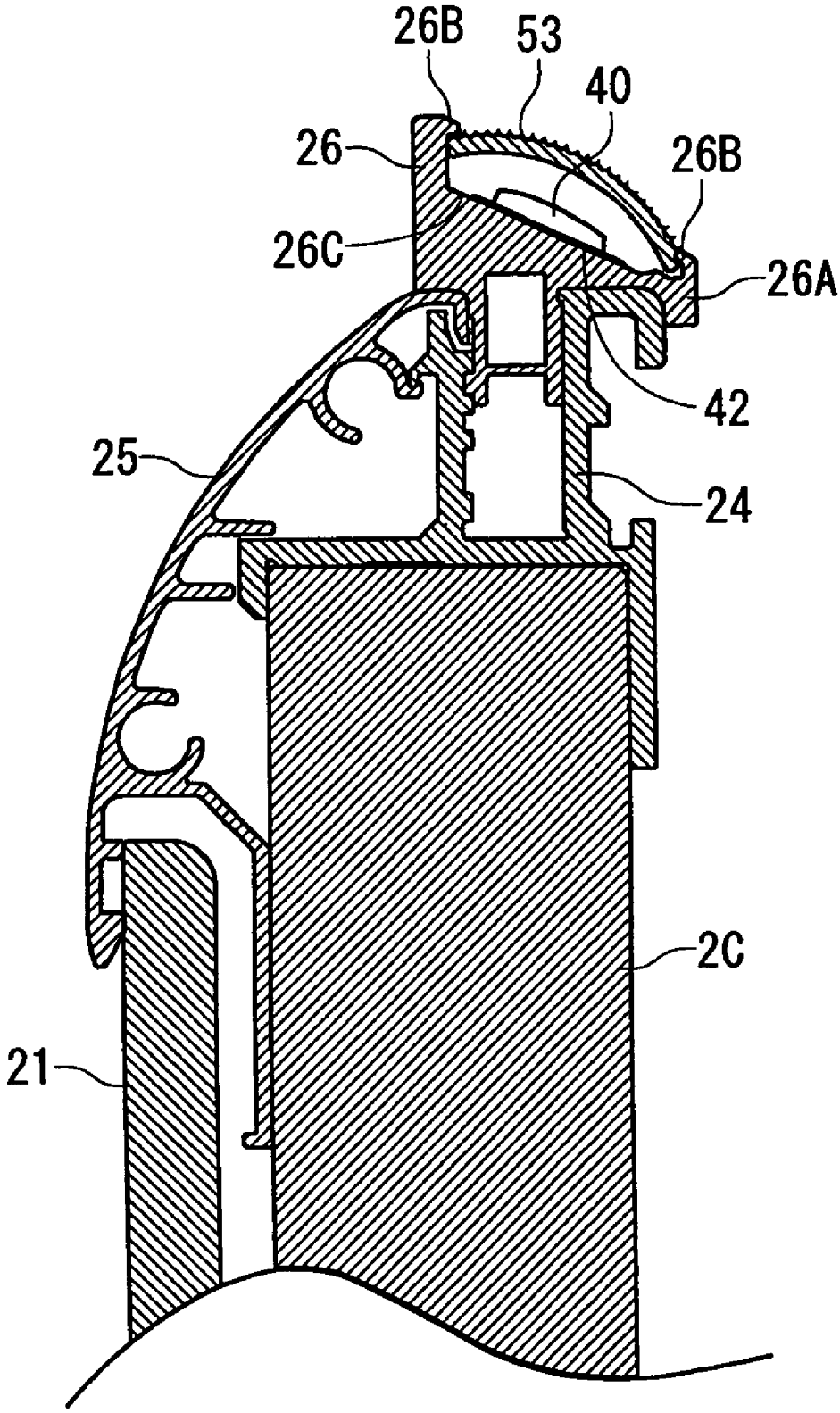
FIG. 9 is an enlarged sectional view of a handle rail part.

In such a case, as shown in FIG. 9, the hand rail 20 of the above embodiment is constituted of a hand rail main body 24 provided over the whole width of the lower edge of the front surface opening 12 of the open showcase 1, a reflective plate 26 provided on an upper surface of the hand rail main body 24 so as to extend over the whole width of the lower edge of the opening 12, and a front surface upper panel 25 which covers the front surface of the hand rail main body 24 from an upper end of the body, and the LED lights 40 are attached to the reflective plate 26.

The reflective plate 26 is constituted of a metal plate, and arranged so as to perform heat exchange between the reflective plate and the hand rail main body 24 or the front surface upper panel 25 similarly constituted of the metal plate. It is to be noted that, for example, an aluminum material having a high heat exchange efficiency is used in the metal plate for use in the reflective plate 26. Then, an upper surface of the reflective plate 26 is provided with a light attachment portion 26A which is recessed over the longitudinal direction, in the same manner as in the reflective plate 45. Front and rear edges of this light attachment portion 26A are provided with engagement claws 26B for detachably attaching a shade 53.

Then, the surface of this light attachment portion 26A which faces the opening is a light attachment surface 26C, and the surface is disposed at an angle opposed to the front surface opening 12 of the display chamber 11 from a lower front part, that is, the surface is constituted so as to face the display chamber 11 in an obliquely rear part above the light attachment surface. The LED lights 40 having a constitution similar to that of the LED lights attached on the inner side of the canopy 33 are attached to the light attachment surface 26C.

Then, the light attachment surface 26C of the light attachment portion 26A is covered with a shade 53 attached so as to surround the LED lights 40 and the like from the upside. The shade 53 has a shape curved at such a predetermined curvature as to protrude toward the front surface opening 12 of the display chamber 11. It is to be noted that front and rear ends of the shade 53 are fitted into the engagement claws 26B of the light attachment portion 26A of the reflective plate 26, whereby the shade is detachably attached. It is to be noted that a constitution of the shade 53 is substantially the same as that of the shade 46, and hence detailed description thereof is omitted.

According to such a constitution, when the LED lights 40 are lit, the irradiation light of the LED lights 40 diffused by the shade 53 can effectively illuminate the whole inside of the display chamber 11 from a lower front position outside the display chamber 11.

Therefore, even in such a constitution, even when light fixtures such as the fluorescent lamps are not provided on the lower surfaces of the shelf plates 32 provided in the display chamber 11 and the like, the faces of the commodities displayed on the shelves can effectively be illuminated in the same manner as in the case where the LED lights 40 are attached to the inner side of the canopy 33 as described above. Therefore, this obviates the need for the light fixtures on the shelves, whereby the power leakage due to the dew condensation can be prevented. This can also obviate the need for the components to be attached to the lights, for example, the sockets for attaching these light fixtures, the stabilizers and the like, and the constitution of the shelves can be simplified.

Moreover, the LED lights 40 attached to the reflective plate 26 can produce a lighting effect similar to that produced in the case where light devices such as the plurality of fluorescent lamps are provided in the display chamber 11 as in the conventional example, so that the power consumption of the whole showcase can remarkably be reduced.

Furthermore, even in this case, the LED lights 40 are provided outside the cold air curtain, whereby the thermal load concerning the lighting in the display chamber 11 can be zeroed, and the lowering of the cooling efficiency of the showcase 1 itself can be prevented in advance. In consequence, the running cost of the whole showcase 1 can be reduced.

In addition, heat generated from the substrates 42 of the LED lights 40 is released in the reflective plate 26 attached to the hand rail main body 24 provided in the vicinity of a cold air suction port such as the outer layer suction port 19, whereby the vicinity of the cold air suction port in which the dew condensation is easily generated can be heated. It is possible to suppress the generation of the dew condensation on the reflective plate 26, the hand rail main body 24 and the front surface upper panel 25 constituting the hand rail 20.

In consequence, the dew condensation can be prevented using the heat released from the LED lights 40, and a heater for preventing the dew condensation does not have to be especially provided on the hand rail 20.

It is to be noted that in the above embodiment, the hand rail 20 is constituted of the hand rail main body 24, the reflective plate 26 and the front surface upper panel 25, but the present invention is not limited to such a constitution. Even in a constitution in which the hand rail 20 is constituted of one component, the hand rail 20 is formed of a metal member, a reflective portion is provided at a position opposed to the front surface opening 12 of the display chamber 11 from a lower front part and the LED lights 40 are attached to the reflective portion, a similar effect is produced.

Moreover, in the above embodiment, the LED lights 40 are attached to the inner side of the canopy 33 and the hand rail 20 to illuminate the inside of the display chamber 11 from the upper front part or the lower front part, but the present invention is not limited to this embodiment. The LED lights 40 may be attached to, for example, the side plates 5 and the like to illuminate the inside of the display chamber 11 from side parts as long as the LED lights 40 are arranged outside the display chamber 11. In consequence, the thermal load concerning the lighting in the display chamber 11 can be zeroed, and the lowering of the cooling efficiency of the open showcase 1 itself can be prevented in advance.

In addition, the LED lights 40 similar to those of the above embodiment may be attached to a ceiling partition plate 8 disposed on a display chamber 11 side of the inner layer discharge port 16, the side plates 5 and the like to illuminate the inside of the display chamber 11 from the upside and the opposite sides. In consequence, the inside of the display chamber 11 can effectively be illuminated.

In the above-mentioned cases, the substrates 42 of the LED lights 40 are attached to portions where the dew condensation is easily generated as in the hand rail 20, or attached so as to perform heat exchange between the substrates and the portions where the dew condensation is easily generated, whereby the dew condensation can be prevented using the heat released from the LED lights 40, and the heater for preventing the dew condensation does not have to be especially provided.

Moreover, in the present embodiment, an example in which the LED lights 40 are attached to a so-called vertical type open showcase has been described, but the present invention is not limited to this embodiment. A similar effect can be produced even with respect to a horizontal type open showcase.

What is claimed is:

1. A showcase to display commodities, the showcase comprising:

a display chamber formed in an insulating wall;

a cooler to generate cold air to cool the commodities;

a plurality of shelves disposed in the display chamber;

LED lights which illuminate the inside of the display chamber from above, the shelves comprising a transparent material;

wherein the cold air is discharged from a cold air discharge port provided in an upper edge of a front surface opening of the display chamber, and sucked into a cold air suction port provided in a lower edge of the opening, to form a cold air curtain in the front surface opening of the display chamber, the showcase further comprising:

a canopy which protrudes forward from an upper front end of the insulating wall; and a reflective plate provided on an inner side of the canopy and positioned before the cold air discharge port, the LED lights being attached to the reflective plate, the front surface opening of the display chamber being irradiated with light emitted from the LED lights.

* * * * *